US007710380B2

(12) United States Patent
Nagato et al.

(10) Patent No.: US 7,710,380 B2
(45) Date of Patent: May 4, 2010

(54) LIQUID CRYSTAL DISPLAY CONTROL CIRCUIT

(75) Inventors: Hidekazu Nagato, Kanagawa (JP); Kiyoshi Miyazaki, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 1001 days.

(21) Appl. No.: 11/447,923

(22) Filed: Jun. 7, 2006

(65) Prior Publication Data

US 2006/0279505 A1 Dec. 14, 2006

(30) Foreign Application Priority Data

Jun. 13, 2005 (JP) ..... 2005-172053

(51) Int. Cl.
*G09G 3/36* (2006.01)

(52) U.S. Cl. ..... 345/99; 345/87; 345/98; 345/100; 345/204

(58) Field of Classification Search ..... 345/55, 345/87, 88, 98, 99, 100, 204, 211, 212, 213, 345/690

See application file for complete search history.

(56) References Cited

U.S. PATENT DOCUMENTS 6,160,533 A * 12/2000 Tamai et al. ..... 345/89
6,211,850 B1 * 4/2001 Komatsu ..... 345/87
6,850,232 B2 * 2/2005 Tazuke ..... 345/204
2005/0259058 A1 * 11/2005 Yamaguchi et al. ..... 345/87

FOREIGN PATENT DOCUMENTS

JP 2004-117742 A 4/2004

* cited by examiner

*Primary Examiner*—My-Chau T Tran
(74) *Attorney, Agent, or Firm*—Sughrue Mion, PLLC

(57) ABSTRACT

A liquid crystal display control circuit comprising a counter, inputted with a first signal for controlling a display status of a display unit and a second signal corresponding to an image data to be displayed on the display unit, for counting clocks for the second signal in 1 cycle of the first signal and for outputting the count value, a latch circuit for latching the number of clocks for the second signal included in 1 cycle of the first signal and for outputting the number of CLKs in 1 cycle, a reference count value circuit for generating a reference count value according to the number of CLKs in 1 cycle, and a comparator for generating a driver control signal that changes a current capacity of the driver unit according to the reference count value and the count value.

17 Claims, 7 Drawing Sheets

LIQUID CRYSTAL DISPLAY CONTROL CIRCUIT

BACKGROUND OF THE INVENTION

1. Field of the Invention

The present invention relates to a liquid crystal display control circuit, and particularly to a liquid crystal display control circuit for driving a liquid crystal display using a high power mode and a low power mode.

2. Description of Related Art

Recently, liquid crystal displays are widely used for portable information equipments such as cell phone and notebook computer. In portable information equipment, reduction in power consumption for longer battery duration is strongly desired. Along with an improvement of processing speed in portable information equipments, high quality display capability is demanded having more display colors and pixels. Display panel such as TFT (Thin Film Transistor) with pixels arranged in matrix are used to satisfy such demand.

In a liquid crystal panel, an image is displayed on a display area by a driver unit of a liquid crystal display control circuit applying a voltage corresponding to a picture signal onto the display area (display unit) including a capacitive load. FIG. 7 is a view showing a liquid crystal panel and its driver unit according to a conventional technique. In order to display a high quality image, voltages for pixels must be switched at high speeds. Accordingly a large current capacity is required for the driver unit in a liquid crystal display control circuit of a liquid crystal panel so as to drive the parasitic capacitance fast. However providing large current capability on a driver unit introduces a problem of increasing a power consumption of the driver unit. To overcome this problem, a technique for lowering a power consumption of the driver unit is disclosed in Japanese Unexamined Patent Application Publication No. 2004-117742.

A technique disclosed in Japanese Unexamined Patent Application Publication No. 2004-117742 provides large current capacity to a driver unit during a period in which a large charge/discharge current is required at a start of driving, in a case of driving pixels in a liquid crystal display (such condition is hereinafter referred to as high power mode). Contrarily in a period in which voltages for pixels are somewhat stable and a large charge/discharge current is not required, current capacity for the driver unit is reduced (such condition is hereinafter referred to as low power mode). Switching between high power mode and lower power mode is carried out by a driver control signal from outside. This is how a reduction of unnecessary current and thus low power consumption is achieved by appropriately changing the current capacity of the driver unit.

In liquid crystal displays generally, switching of display mode such as the number of display pixels or switching to a partial mode for restricting a display area is performed. If the display mode is changed, a switch timing for switching between high power mode and low power mode in the driver unit may need to be altered as well.

In such a case, a conventional liquid crystal display control circuit stores outside a switch timing for switching between high and low power modes for the driver unit depending on the display mode. An appropriate stored timing needs to be selected to be used depending on the display mode.

However it has been discovered that prepared display modes may not be able to cover all display modes even if a setting for mode change of a driver unit is prepared in advance in accordance with display modes, because the display mode is often changed by a user specification.

SUMMARY OF THE INVENTION

According to an aspect of the present invention, there is provided a liquid crystal display control circuit, inputted with a first signal for controlling display status of a display unit and a second signal corresponding to an image data to be displayed on the display unit, that includes a counter for counting clocks of the second signal included in 1 cycle of the first signal, a latch circuit for latching the number of clocks of the second signal included in 1 cycle of the first signal and for outputting the number of CLKs in 1 cycle, a reference count value circuit for generating a reference count value according to the number of CLKs in 1 cycle, and a comparator for generating a driver control signal that changes a current capacity of the driver unit based on the reference count value and the count value.

According to another aspect of the present invention, there is provided a liquid crystal display control circuit that generates a reference count value in a reference count value circuit having a given ratio to the number of CLK in 1 cycle that indicates the number of clocks of a second signal included in 1 cycle of a first signal. By a comparator comparing the generated reference count value and a count value of a counter, a driver control signal is generated for changing a current capacity of the driver unit. Accordingly, the driver control signal is capable of controlling the driver unit at a given ratio in 1 cycle of the first signal, under several different conditions. Further, the driver unit consumes large power when current capacity is high, while the driver unit consumes small power when current capacity is low. That is, controlling the driver unit enables the driver unit to have a period of operating with large power consumption as well as a period of operating with small power consumption at a given ratio in a first period. This allows to adequately reduce power consumption of the driver unit at a given ratio. The reference count value circuit achieves power consumption reduction effect at a given ratio regardless of display resolution or display mode, because the reference count value is generated at a given ratio to the number of CLKs in 1 cycle.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

First Embodiment

Figure 1:
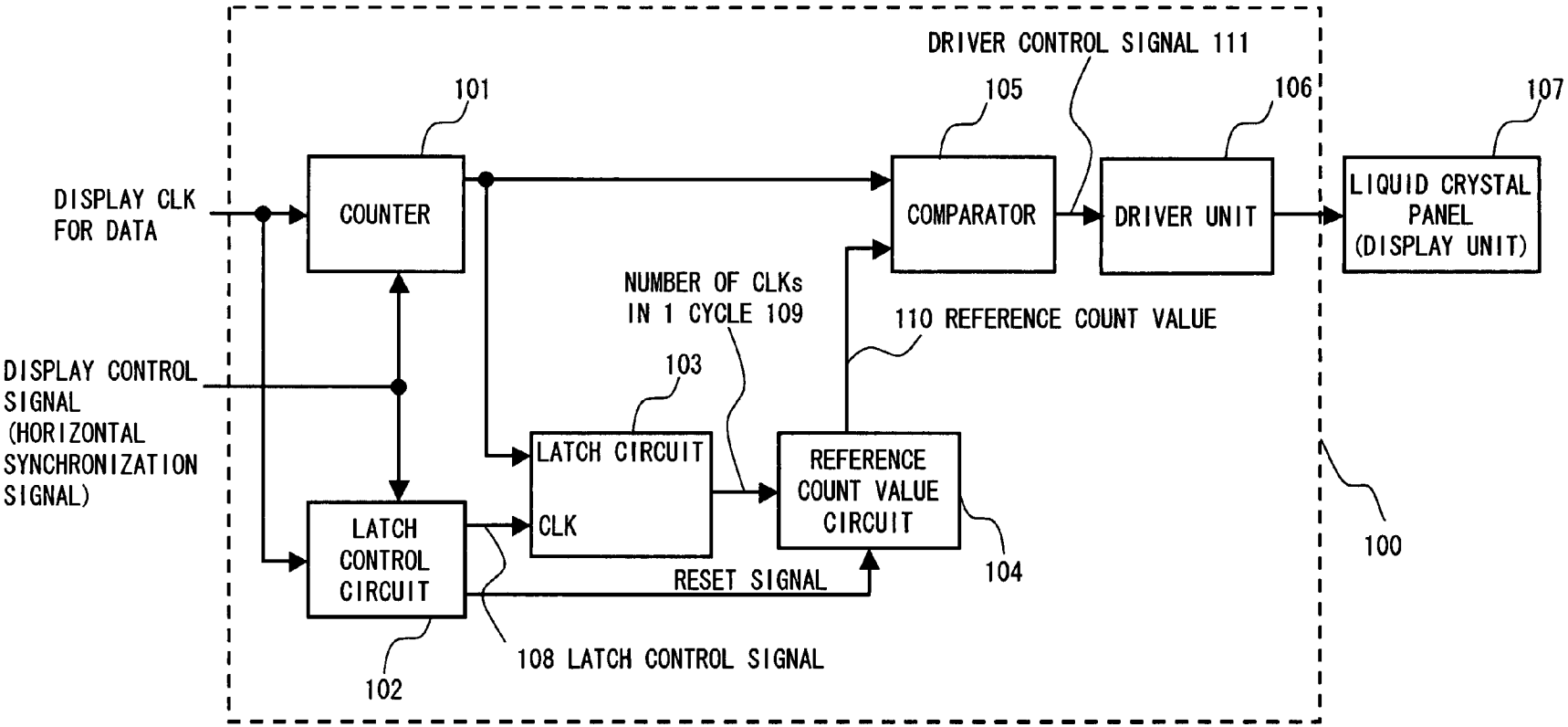
FIG. 1 is a block diagram showing a liquid crystal display control circuit according to a first embodiment.

A liquid crystal display control circuit 100 according to a first embodiment is shown in FIG. 1. As shown in FIG. 1, the liquid crystal display control circuit 100 is inputted with a display control signal and a display CLK for data, and includes a counter 101, a latch control circuit 102, a latch circuit 103, a reference count value circuit 104, a comparator 105, and a driver unit 106. An output of the driver unit 106 is connected to a liquid crystal panel 107, for example, which is used as a display unit.

The display control signal is a first signal and a horizontal synchronization signal for synchronizing in horizontal direction of a display screen, for example. One cycle of the horizontal synchronization signal (a period from a rising edge to the next rising edge of a signal) is referred to as 1H period hereinafter. Duration of 1H period is constant as long as an aspect ratio of a display screen remains the same. A display CLK for data is a second signal and a clock signal that a cycle is changed depending on the number of pixels for an image data to be displayed, for example. If the number of display pixels is small, the number of display CLKs for data in 1H period is small, whereas if the number of display pixels is large, the number of display CLKs for data in 1H period is large.

The counter 101, inputted with a display CLK for data and a display control signal, is a circuit for outputting a count value of display CLKs for data (a first count value for example) in 1H period.

The latch control circuit 102, inputted with a display CLK for data and a display control signal, synchronizes with the display control signal and outputs a reset signal at a predetermined cycle. The latch control circuit 102 further outputs a latch control signal to the latch circuit according to the reset signal and the display control signal.

The latch circuit 103, inputted with the latch control signal and the count value of the counter 101, latches the number of clocks counted by the counter in 1H period based on the latch control signal and outputs the number of CLKs in 1H period.

The reference count value circuit 104 is inputted with the reset signal and the number of CLKs in 1H period. The reference count value circuit 104 erases a reference count value being outputted in response to the reset signal, and generates a reference count value that is calculated by multiplying the newly inputted number of CLKs in 1H period by a given ratio (for example 1/2 or 1/3). This specifies a first and a second period.

The comparator 105 (or a signal generation circuit) compares the count value of the counter 101 with the reference count value. If the count value of the counter 101 is larger than the reference count value, the comparator 105 outputs a driver control signal specifying a low power mode (a second mode, for instance) to the driver unit 106. The driver control signal is a signal for specifying high power mode (a first mode, for instance) to the driver unit 106 if the count value of the counter 101 is smaller than the reference count value.

The driver unit 106 is a circuit for driving a liquid crystal panel, for example. When driving a liquid crystal panel, the driver unit 106 changes a current capacity to be outputted according to the driver control signal. As an example, there are high power mode for driving the liquid crystal panel with high current capacity, and low power mode for driving the liquid crystal panel with low current capacity.

Figure 2A:
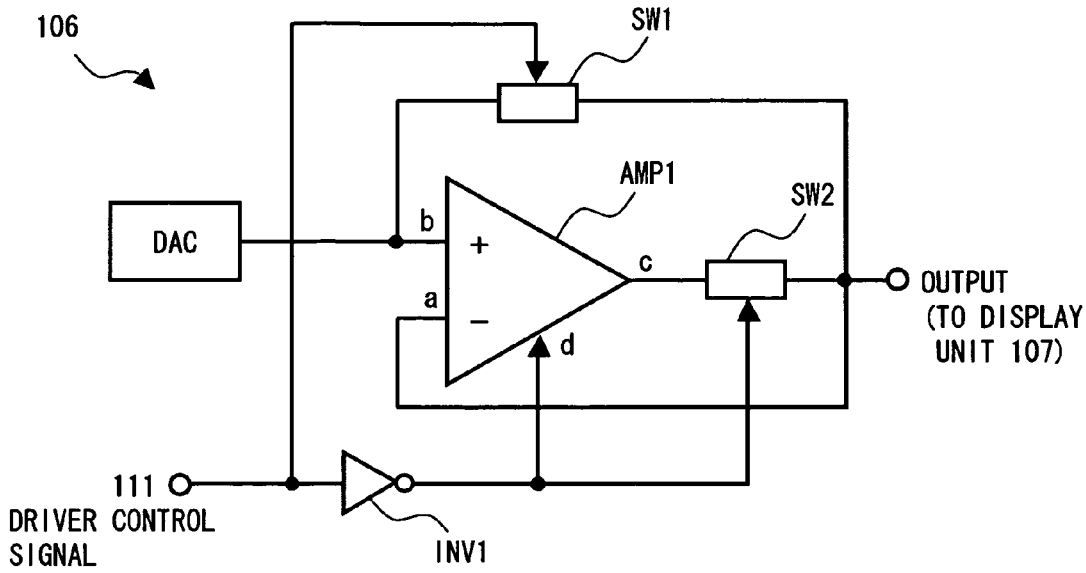
FIGS. 2A and 2B are circuit diagrams showing an example of a driver unit according to the first embodiment.
Figure 2B:
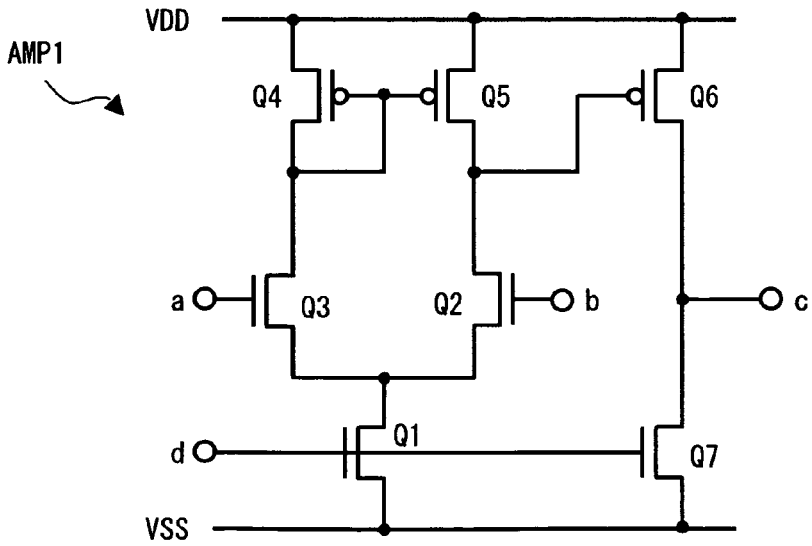

An example of an internal circuit of the driver unit 106 is shown in FIGS. 2A and 2B. FIG. 2A shows an overall circuit of the driver unit 106. FIG. 2B shows an example of a circuit of an amplifier AMP 1. The driver unit 106 is described hereinafter in detail with reference to FIGS. 2A and 2B.

As shown in FIG. 2A, the driver unit 106 includes an amplifier portion AMP 1, switches SW 1 and SW 2, an inverter INV 1, and a DAC (Digital Analog Converter). The driver unit 106 has high and low power mode. Operations of the driver 106 in each of the modes are explained hereinafter in detail.

In high power mode, a driver control signal 111 is set to Low level. This causes a signal of Low level to be inputted to the switch SW 1, thereby making the switch SW 1 to be non-conductive. As a High level signal is inputted to a terminal d of the amplifier AMP 1 and the SW 2 via the inverter INV 1, the amplifier AMP 1 is activated and the switch SW2 is made conductive.

As the switch SW 2 is conductive, the amplifier AMP 1 is connected with an output terminal c and an inverting terminal a, and operates as a buffer. The DAC converts a digital signal of an image to be displayed on the liquid crystal panel 107 into an analog signal and outputs the analog signal to a non-inverting terminal b of the amplifier AMP 1. That is, in high power mode, the driver 106 drives the liquid crystal panel 107 with high current capacity by outputting a digital signal generated in the DAC via a buffer.

The amplifier AMP 1 is described hereinafter in detail with reference to FIG. 2B. When a High level signal is inputted from the terminal d to the amplifier portion AMP 1, NMOS transistors Q1 and Q7 become conductive and the amplifier AMP 1 is activated. Further, when a Low level signal is inputted from the terminal d, NMOS transistors Q1 and Q7 become non-conductive and an operation of the amplifier AMP 1 is deactivated. That is, in high power mode, as a High level signal is inputted to the terminal d, the amplifier AMP 1 controls a PMOS transistor Q6 according to a voltage inputted to the non-inverting terminal b and outputs an analog signal with high current capacity to the output terminal c.

In low power mode, the driver control signal 111 is High level. This leads the switch SW 1 to be inputted with a High level signal, and the switch SW 1 to be conductive. As a Low level signal is inputted to the terminal d of the amplifier AMP 1 and the switch SW2 via the inverter INV 1, the amplifier portion AMP 1 is deactivated and the switch SW2 becomes non-conductive. That is, the DAC to an output of the driver unit 106 become conductive and the amplifier portion AMP 1 is not operating, thus the liquid crystal panel 107 is driven by an output from the DAC having a small current capacity.

Figure 3A:
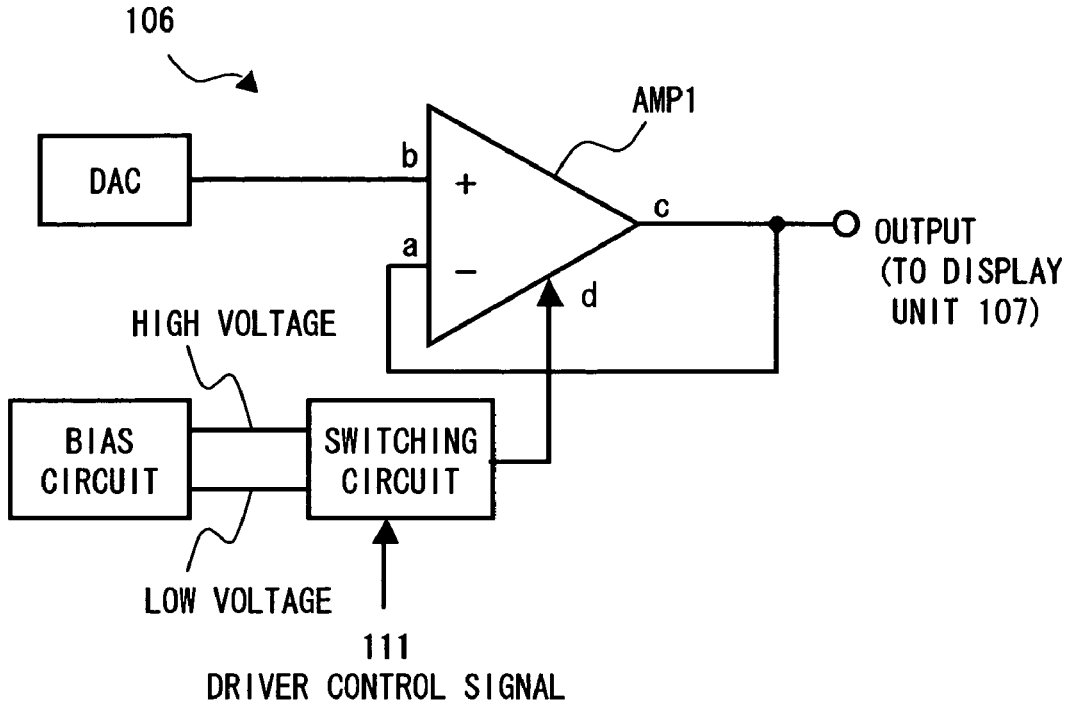
FIGS. 3A and 3B are circuit diagrams showing another example of a driver unit according to the first embodiment.
Figure 3B:
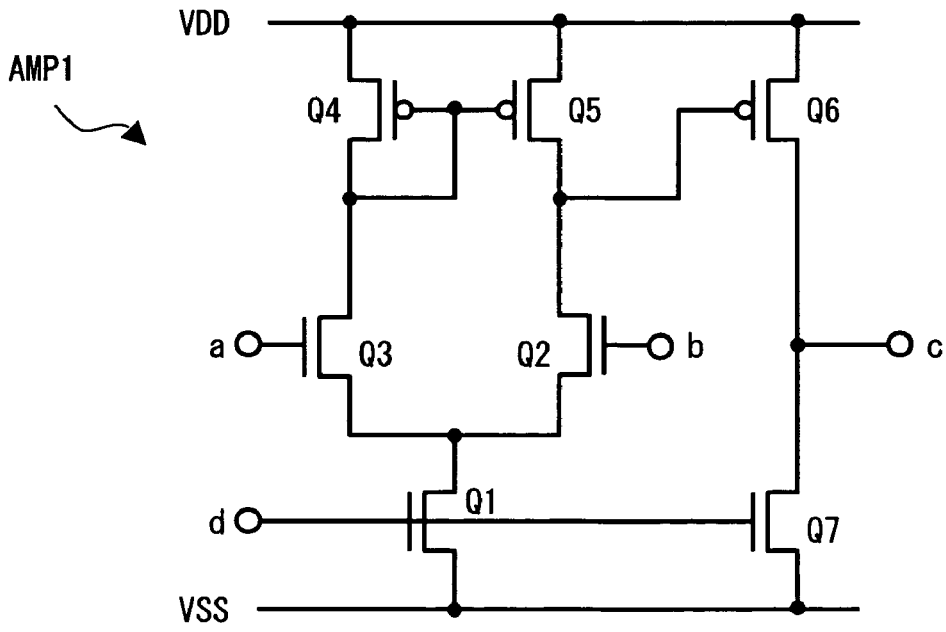

Another example of an internal circuit of the driver unit 106 is shown in FIGS. 3A and 3B. FIG. 3A shows an overall circuit of the driver unit 105. FIG. 3B shows an example of a circuit of the amplifier AMP 1. Another example of the driver unit 106 is described hereinafter with reference to FIGS. 3A and 3B.

As shown in FIG. 3A, the driver unit 106 includes an amplifier AMP 1, a bias circuit, a switching circuit, and a DAC. The bias circuit is a circuit for generating a high and low voltage that specifies a current capacity of the amplifier AMP 1. The switching circuit is a circuit for selecting either the high or low voltage generated by the bias circuit based on a driver control signal 111 and supplying the selected voltage to the amplifier AMP 1. In the driver unit 106 shown in FIG. 3A, in case of high power mode, the switching circuit selects the high voltage to be supplied to the amplifier AMP 1, while in case of low power mode, the switching circuit selects the low voltage to be supplied to the amplifier AMP 1.

An analog signal is inputted to the amplifier AMP 1 from the non-inverting terminal b via the DAC. Further, the amplifier AMP 1 is configured in which the output terminal c and the inverting terminal a is connected. Further, the high or low voltage selected by the switching circuit is inputted to the terminal d. That is, the driver unit 106 shown in FIG. 3A is for switching the current capacity of the amplifier AMP 1 by switching a voltage to supply to the terminal d of the amplifier AMP 1 according to the driver control signal 111.

The amplifier AMP 1 is described hereinafter in detail with reference to FIG. 3B. Comparing a case when the high voltage is inputted and a case when the low voltage is inputted from the terminal d to the amplifier AMP 1, the NMOS transistors Q1 and Q7 become more conductive when the high voltage is inputted. That indicates that the amplifier AMP 1 has higher current capacity when the high voltage is inputted to the terminal d, whereas the amplifier AMP 1 has lower current capacity when the low voltage is inputted.

The liquid crystal display control circuit 100 of the first embodiments outputs a count value that counts the display CLK for data in 1H period by the counter 101. The latch circuit 103 latches the count value of the display CLK for data in 1H period according to a latch control signal and outputs the number of CLKs in 1H period. The reference count value circuit 104 multiplies the number of CLKs in 1H period by a given ratio and outputs a reference count value. The comparator 105 compares the reference count value with the count value outputted by the counter 101 and outputs a driver control signal. That is, the liquid crystal display control circuit 100 is a circuit for setting a ratio of a length of high power mode period (a first period, for example) to a length of lower power mode period (a second period, for example) to be a given ratio determined in the reference count value circuit.

In a case the reference count value is fixed, if the number of display CLKs for data in 1H period varies, the ratio of the high power mode period to the low power mode period in 1H period correspondingly changes. However the liquid crystal display control circuit 100 of the first embodiment inserts a refresh period at a regular interval to change the reference count value. This enables the ratio of the high power mode period to the low power mode period in 1H period to be a given ratio even if the number of display CLKs for data included in 1H period changes.

Figure 4:
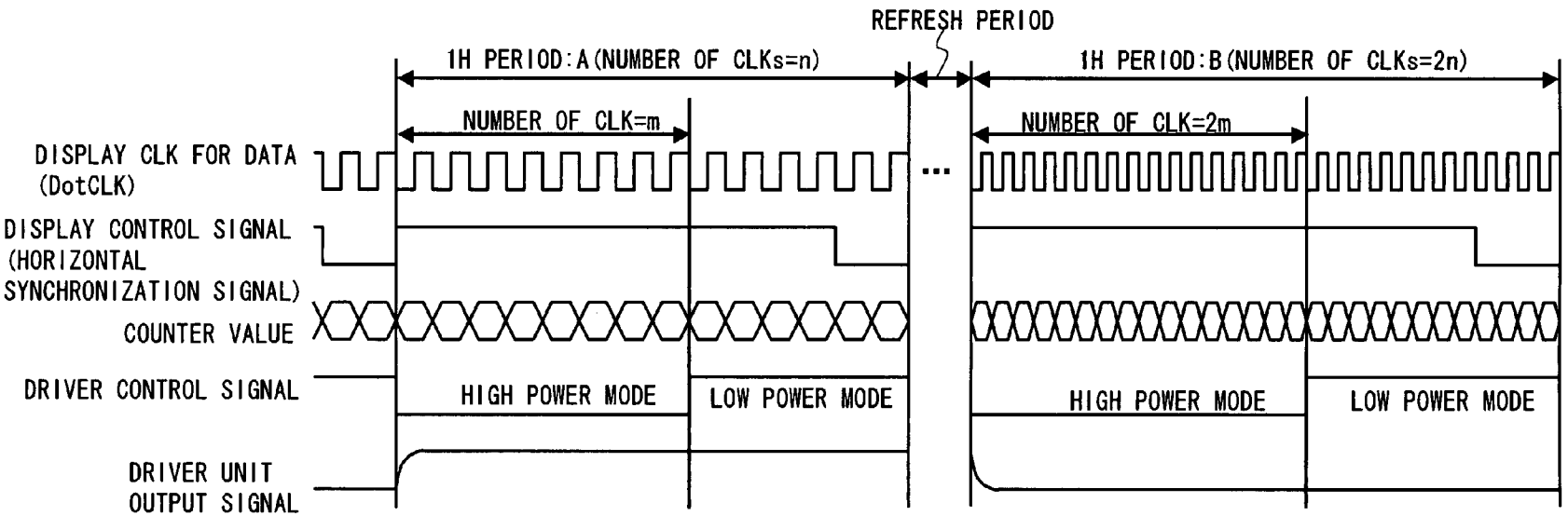
FIG. 4 is a timing chart showing an operation of a liquid crystal display control circuit according to the first embodiment.

An operation of the liquid crystal display control circuit 100 of the first embodiment is described hereinafter in detail. An example of a timing chart for an operation of the liquid crystal display control circuit 100 according to the first embodiment is shown in FIG. 4. The timing chart in FIG. 4 includes a period A, in which n (wherein n is an integer) number of display CLKs for data in 1H period are inputted, and a period B, in which 2n number of display CLKs for data in 1H period are inputted. In the liquid crystal display control circuit 100, the ratio of the high power mode period to the low power mode period is maintained to be m/n at any point in the period A and B. Note that m indicates a smaller integer than n.

The period A is explained to begin with. The liquid crystal display control circuit 100 is inputted with the display CLK for data and the display control signal. The counter 101 outputs a count value that counts the display CLK for data. At this time the reference count value circuit 104 outputs a reference count value m corresponding to the number of display CLKs for data in 1H period, n. Accordingly in a period when the count value of the counter 101 is smaller than the reference count value m, the comparator 105 outputs a signal that makes the driver unit 106 be high power mode. On the other hand in a period when the count value of the counter 101 is larger than the reference count value m, the comparator 105 outputs a signal that makes the driver unit 106 be low power mode.

The period B is explained next. As opposed to the period A in which the number of display CLKs for data in 1H period is n, the number of display CLKs for data in 1H period for the period B is 2n, twice the number of the period A. The liquid crystal display control circuit 100 is inputted with the display CLK for data and the display control signal. The counter 101 outputs a count value that counts the display CLK for data. At this time, the reference count value circuit 104 outputs a reference count value 2m having the same ratio (m/n) as the period A to the number of display CLKs for data in 1H period, 2n. Accordingly in a period when the count value of the counter 101 is smaller than the reference count value 2m, the comparator 105 outputs a signal that makes the driver unit 106 be high power mode. On the other hand in a period when the count value of the counter 101 is larger than the reference count value 2m, the comparator 105 outputs a signal that makes the driver unit 106 be low power mode.

Figure 5:
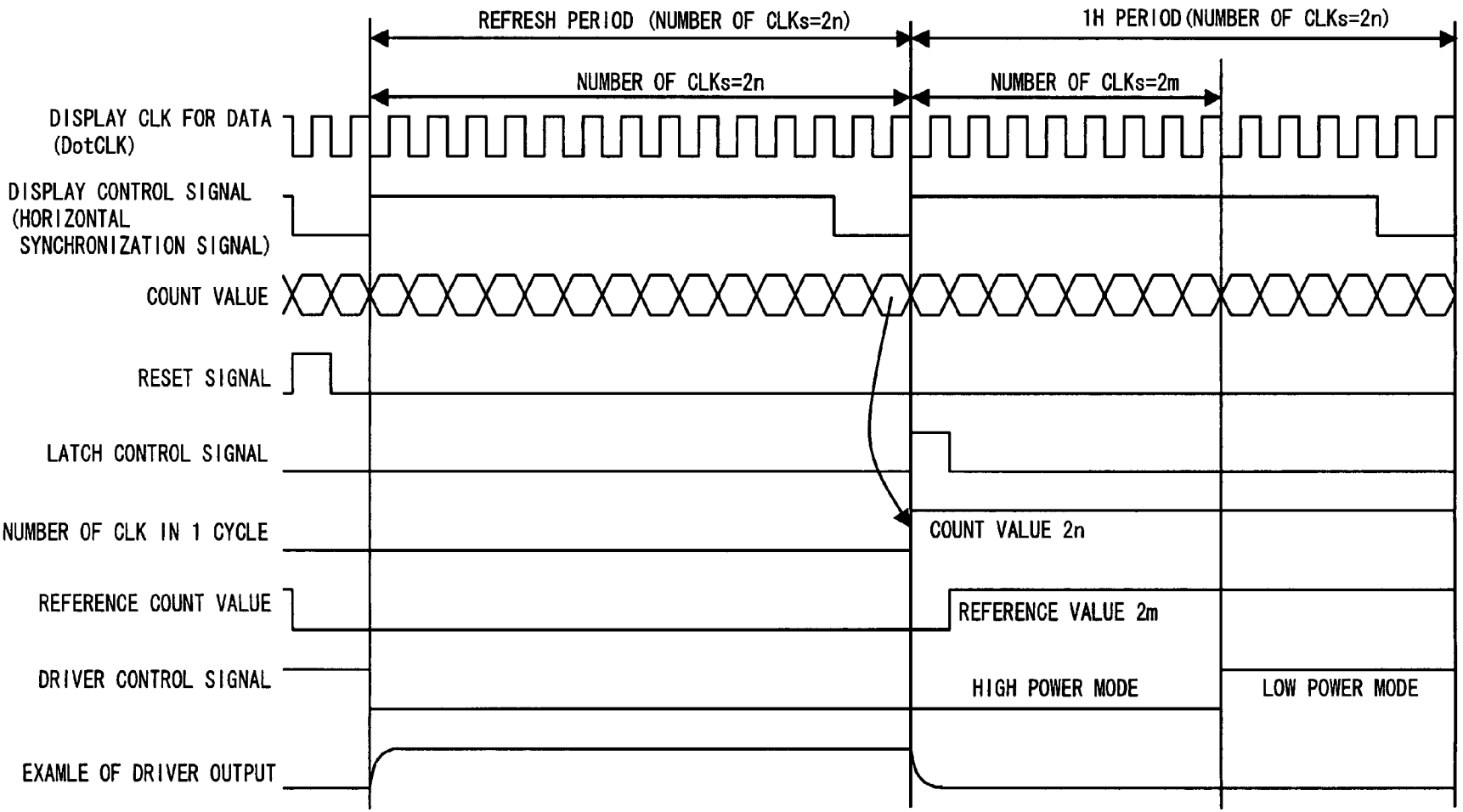
FIG. 5 is a timing chart showing an operation of changing a reference count value for a liquid crystal display control circuit according to the first embodiment.

In the period A and B, the ratio of the number of display CLKs for data in 1H period in the high power mode period to the low power mode period is the same. However the count value of the counter 101 that switches from high power mode to low power mode is m in the period A, and 2m in the period B. That means the reference count value, a reference for switching from high power mode to low power mode, needs to be changed. Accordingly the liquid crystal display control circuit 100 of this embodiment includes a refresh period that the reference count value outputted by the reference count value circuit 104 is recalculated between the period A and B. The refresh period is synchronized with a horizontal synchronization signal, for example, and inserted periodically. A timing chart for operations of the liquid crystal display during the refresh period and after the refresh period is shown in FIG. 5.

An operation of the liquid crystal display control circuit 100 during the refresh period and after the refresh period is described hereinafter in detail with reference to FIG. 5. At a rising edge of the reset signal outputted by the latch control circuit 102, a reference count value up to that point are reset. The refresh period starts at a first rising edge of a display control signal inputted after the reset signal rise. The reset signal is synchronized with the display control signal and periodically outputted according to the number of falling edges of the display control signal. For example, the reset signal is outputted once if the display control signal falls 5 times.

The counter 101 starts counting the display CLK for data according to a rising edge of the display control signal. At this time, the driver control signal switches from low power mode to high power mode based on a completion of 1H period before the refresh period.

The refresh period ends at a falling edge of the display control signal after a rising edge of the display control signal that the refresh period starts at. The counter 101 counts the number of display CLKs for data in 1H period during the refresh period.

When the refresh period ends, a latch control signal outputted by the latch control circuit 102 rises in accordance with a rising edge of the display control signal that the refresh period ends at. According to the rising edge of the latch control signal, the latch circuit 103 latches the count value of the counter 101 and outputs it to the reference count value circuit 104. If 2n number of display CLKs for data are counted during 1H period of the refresh period, the latch circuit 103 outputs the count value 2n to the reference count value circuit 104.

The reference count value circuit 104 outputs the reference count value 2m having a ratio of m/n for an inputted count value, 2n. The calculation performed by the reference count value circuit 104 can be expressed by X×r=Y, wherein X is a count value inputted to the reference count value circuit 104, Y is a reference count value outputted by the reference count value circuit 104, and r is a ratio between X and Y.

A switch between high and low power mode is conducted based on the reference count value 2m, that is calculated according to the number of display CLKs for data in 1H period, which is 2n, obtained during the refresh period, and the count value of the counter 101.

Thus for a period in which the count value of the counter 101 is smaller than the reference count value 2m, the comparator 105 outputs a signal that makes the driver unit 106 be high power mode. For a period in which the count value of the counter 101 is larger than the reference count value 2m, the comparator 105 outputs a signal that makes the driver unit 106 be low power mode.

As described in the foregoing, in the liquid crystal display control circuit 100 of the first embodiment, a ratio of periods in which the driver unit operates in high power mode and low power mode is determined by a ratio of the number of clocks based on display CLK for data in 1H period. This enables to maintain a ratio of operation time for high power mode and low power mode to be substantially constant. It indicates that reduction effect of power consumption can be achieved with any number of display pixels.

Inserting refresh periods at a given interval allows to change a reference count value during an operation even when the number of display pixels is altered while using a liquid crystal panel. This makes it possible to realize reduction effect of power consumption in a driver unit at substantially constant level even when the number of display pixels changes during an operation.

Second Embodiment

Figure 6:
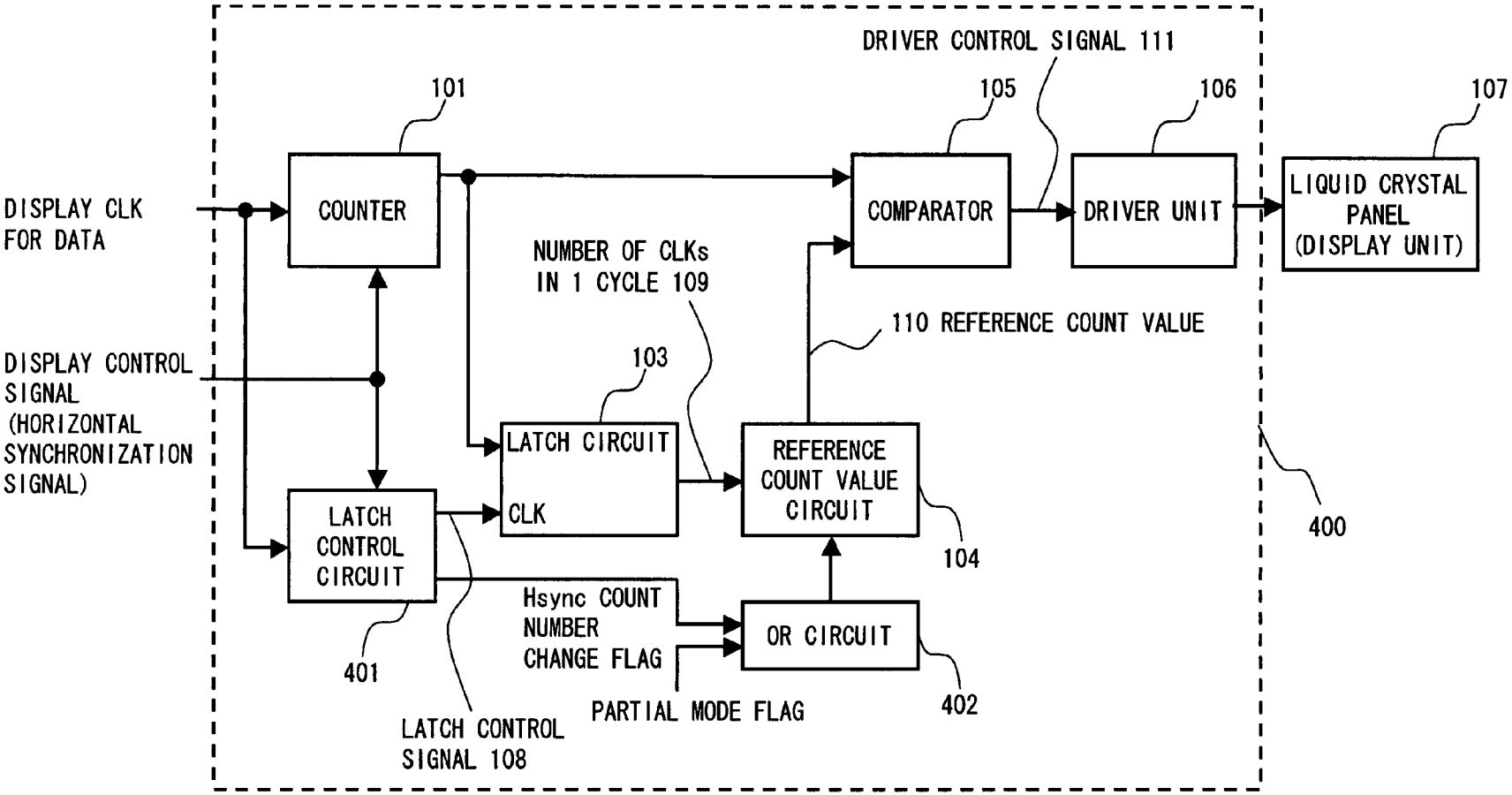
FIG. 6 is a block diagram showing a liquid crystal display control circuit according to a second embodiment.
Figure 7:
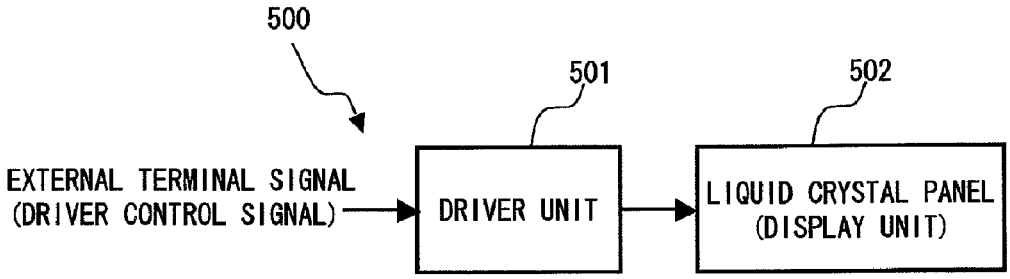
Fig. 7 (Prior Art)
FIG. 7 is a block diagram showing a liquid crystal display control circuit according to a conventional technique.

A liquid crystal display control circuit of a second embodiment is shown in FIG. 6. The liquid crystal display control circuit 100 of the first embodiment specifies a refresh period by a reset signal, whereas the liquid crystal display control circuit 400 of the second embodiment specifies a refresh period according to a Hynsc count number change flag generated by a latch control circuit based on a display control signal or a partial mode flag. The only difference between the liquid crystal display control circuit 100 of the first embodiment and the liquid crystal display control circuit 400 of the second embodiment is a method to specify a refresh period. In the liquid crystal display control circuit 400 of the second embodiment, constituents and operations practically identical to those in the liquid crystal display control circuit 100 of the first embodiment are denoted by reference numerals identical to those therein with detailed description omitted.

The liquid crystal display control circuit 400 of the second embodiment includes a latch control circuit 401 instead of the latch control circuit 102 in liquid crystal display control circuit 100, further includes a OR circuit 402.

The latch control circuit 401 outputs the Hsync count number change flag based on a ratio between 1H period of a horizontal synchronization signal and 1V period of a vertical synchronization signal for a display control signal, in addition to a latch control signal to the latch circuit 103. The vertical synchronization signal is a signal for synchronizing in vertical direction of an image to be displayed on a liquid crystal panel. One cycle of the vertical synchronization signal is hereinafter referred to as 1V period. If the ratio between 1H period and 1V period changes, an aspect ratio of a display screen changes correspondingly. For example as a value of (1H period/1V period) increases, the number of display pixels in a vertical direction of the display screen increases, whereas as a value of (1H period/1V period) decreases, the number of display pixels in a horizontal direction of the display screen increases. The Hsync count number change flag is activated when the ratio between 1H period and 1V period widely changes. Furthermore, the Hsync count number change flag becomes High when the ratio between 1H period and 1V period is smaller than (the number of display lines/10).

The OR circuit 402 is inputted with the Hsync count number change flag and a partial mode flag. In a case when either one of the flags is inputted, the OR circuit 402 outputs a signal for changing a calculation method of the reference count value circuit 104.

A partial mode is a mode for restricting an image display area of a liquid crystal panel. In other words, in partial mode, an image is displayed only on a part of a liquid crystal panel, suspending operations of pixels for non-displaying portion, thereby reducing power consumption. The partial mode flag is activated when operating a liquid crystal panel in partial mode. Therefore, even in a partial mode, an aspect ratio of an image to be displayed on a liquid crystal panel varies in a similar case in which Hsync count number change flag is activated.

The liquid crystal display control circuit 400 of the second embodiment is a circuit where an output from the OR circuit 402 changes the calculation method of the reference count value circuit 104 when the aspect ratio of a display screen for a liquid crystal panel widely changes.

Generally if an aspect ratio of a screen changes, a length of 1H period changes as well. In the liquid crystal display control circuit 400 of the second embodiment, even when the aspect ratio of a screen changes, a calculation method of the reference count value circuit 104 can be changed in accordance with a length of 1H period at that time. In other words, when a length of 1H period changes, a ratio between high power mode and low power mode depending on the length of 1H period can be specified. Thus the liquid crystal display control circuit 400 of the second embodiment makes it possible to appropriately reduce power consumption regardless of an aspect ratio of a screen display.

The present invention is not restricted to the above-mentioned embodiments but various changes can be made. For example switching between high and low power mode is not limited to a horizontal synchronization signal but may be carried out in 1V period of a vertical synchronization signal, or any other signal capable of controlling a display condition of an image. Further, a calculation method in the reference count value circuit may be appropriately specified.

The present invention compares a reference count value that is to be a given ratio to the number of clocks inputted in a given period and controls a driver unit. Accordingly it is possible to generate a reference count value at each given period without inserting refresh periods.

It is apparent that the present invention is not limited to the above embodiment and it may be modified and changed without departing from the scope and spirit of the invention.

What is claimed is:

1. A liquid crystal display control circuit comprising:

a counter, inputted with a display control signal for controlling a display status of a display unit and a display clock signal corresponding to an image data to be displayed on the display unit, for counting a number of clock pulses of the display clock signal in 1 cycle of the display control signal and for outputting the number of clock pulses of the display clock signal in 1 cycle of the display control signal as a first count value, and for counting a number of clock pulses during a cycle of the display control signal as a second count value;

a reference count value circuit inputted with the first count value, for calculating a reference count value based on the first count value; and a comparator for generating a driver control signal that changes a current capacity of the driver unit, wherein the driver control signal has a first value when the reference count value is greater than the second count value and the driver control signal has a second value when the reference count value is less than the second count value.

2. The liquid crystal display control circuit according to claim 1, wherein the reference count value circuit recalculates the reference count value at a given cycle.

3. The liquid crystal display control circuit according to claim 2, wherein there is a given ratio between the reference count value and the first count value.

4. The liquid crystal display control circuit according to claim 3, wherein the reference count value is smaller than the first count value.

5. The liquid crystal display control circuit according to claim 4, wherein the driver unit includes a high power mode in which the display unit is driven with high current capacity, and a lower power mode in which the display part is driven with low current capacity according to the driver control signal.

6. The liquid crystal display control circuit according to claim 1, wherein there is a given ratio between the reference count value and the first count value.

7. The liquid crystal display control circuit according to claim 6, wherein the reference count value is smaller than the first count value.

8. The liquid crystal display control circuit according to claim 7, wherein the driver unit includes a high power mode in which the display unit is driven with high current capacity, and a lower power mode in which the display part is driven with low current capacity according to the driver control signal.

9. The liquid crystal display control circuit according to claim 1, wherein the reference count value is smaller than the first count value.

10. The liquid crystal display control circuit according to claim 9, wherein the driver unit includes a high power mode in which the display unit is driven with high current capacity, and a lower power mode in which the display part is driven with low current capacity according to the driver control signal.

11. The liquid crystal display control circuit according to claim 1, wherein the driver unit includes a high power mode in which the display unit is driven with high current capacity, and a lower power mode in which the display part is driven with low current capacity according to the driver control signal.

12. A liquid crystal display control circuit comprising:

a reference count value circuit, inputted with a control display signal specifying a series of given periods and a display clock signal corresponding to an image data to be displayed on the display unit, for generating a reference count value, wherein there is a given ratio between the reference count value and a number of clock pulses of the display clock signal inputted during one given period of the control display signal;

a counter for counting the number of clock pulses of the display clock signal in a subsequent given period of the control display signal and thus generating a count value; and a comparator for generating a driver control signal that changes a current capacity of a driver unit based on the reference count value and the count value.

13. The liquid crystal display control circuit according to claim 12, wherein the reference count value circuit recalculates the reference count value at a given cycle.

14. The liquid crystal display control circuit according to claim 13, wherein the driver unit includes a high power mode in which the display unit is driven with high current capacity, and a lower power mode in which the display part is driven with low current capacity according to the driver control signal.

15. The liquid crystal display control circuit according to claim 12, wherein the driver unit includes a high power mode in which the display unit is driven with high current capacity, and a lower power mode in which the display part is driven with low current capacity according to the driver control signal.

16. A control circuit of a display apparatus comprising:

a reference count value circuit for generating a reference count value based on a horizontal synchronization signal and a display clock signal, wherein the reference count value specifies a given ratio between a first period and a second period, and wherein a sum of the first period and the second period is one period of the horizontal synchronization signal; and a comparator for generating a driver control signal for a first mode in the first period and for generating the driver control signal for a second mode in the second period based the reference count value.

17. The liquid crystal display control circuit of claim 1, further comprising a latch circuit for latching the first count value and for outputting the latched first count value to the reference count value circuit.

* * * * *

UNITED STATES PATENT AND TRADEMARK OFFICE

CERTIFICATE OF CORRECTION

PATENT NO. : 7,710,380 B2
APPLICATION NO. : 11/447923
DATED : May 4, 2010
INVENTOR(S) : Hidekazu Nagato and Kiyoshi Miyazaki It is certified that error appears in the above-identified patent and that said Letters Patent is hereby corrected as shown below:

Claim 16, Column 10, Line 52, delete "based the" and insert --based on the--.

Signed and Sealed this

Twenty-sixth Day of October, 2010

David J. Kappos

David J. Kappos
*Director of the United States Patent and Trademark Office*